US009290283B2

(12) United States Patent
Cinotti et al.

(10) Patent No.: US 9,290,283 B2
(45) Date of Patent: Mar. 22, 2016

(54) METHOD AND APPARATUS FOR WRAPPING A FOLIO REAM OF PAPER

(71) Applicant: PEMCO INC., Sheboygan, WI (US)

(72) Inventors: Andrea Cinotti, Bologna (IT); Thomas Ullmer, Sheboygan, WI (US); Kevin J. Ruh, Elkhart Lake, WI (US); Christopher Lee Lambie, Grafton, WI (US)

(73) Assignee: PEMCO INC., Sheboygan, WI (US)

( * ) Notice: Subject to any disclaimer, the term of this patent is extended or adjusted under 35 U.S.C. 154(b) by 483 days.

(21) Appl. No.: 13/790,166

(22) Filed: Mar. 8, 2013

(65) Prior Publication Data

US 2013/0239521 A1 Sep. 19, 2013

Related U.S. Application Data

(60) Provisional application No. 61/611,826, filed on Mar. 16, 2012.

(51) Int. Cl.

| | |
|---|---|
| ***B65B 11/12*** | (2006.01) |
| ***B65B 51/02*** | (2006.01) |
| ***B65B 25/14*** | (2006.01) |
| ***B65B 11/10*** | (2006.01) |

(52) U.S. Cl.

CPC ..... *B65B 11/12* (2013.01); *B65B 11/10* (2013.01); *B65B 25/14* (2013.01); *B65B 51/02* (2013.01)

(58) Field of Classification Search

CPC ..... B65B 11/12; B65B 11/10; B65B 25/14; B65B 51/02–51/26; B65B 49/08; B65B 11/004

USPC ..... 53/466, 229, 373.3, 461, 462, 203, 228; 414/789.1

See application file for complete search history.

(56) References Cited

U.S. PATENT DOCUMENTS

| | | | |
|---|---|---|---|
| 3,279,146 | A | 10/1966 | Ficht |
| 3,559,367 | A | 2/1971 | Misik |
| 3,559,810 | A | 2/1971 | Lee et al. |
| 3,564,810 | A | 2/1971 | Faletti |
| 3,604,182 | A | 9/1971 | Jepsen |
| 3,729,886 | A | 5/1973 | Lucas et al. |
| 3,750,361 | A | 8/1973 | Stevens |

(Continued)

FOREIGN PATENT DOCUMENTS

| | | |
|---|---|---|
| EP | 0563649 A2 | 10/1993 |
| JP | 63-252842 | 10/1988 |

(Continued)

*Primary Examiner* — Robert Long
*Assistant Examiner* — Xavier A Madison
(74) *Attorney, Agent, or Firm* — Marshall, Gerstein & Borun LLP

(57) ABSTRACT

A method and apparatus for wrapping a folio ream. The method comprises pre-creasing a wrap sheet and driving the ream into the wrap sheet toward a fold position. A bubble of wrap is formed in the wrap sheet, which is cut while the ream advances, such that a lower flap of the wrap sheet extends beyond the rear edge of the ream. An upper flap fold is formed on the rear edge of the ream, and glue is applied to the lower flap as it is held flat via a vacuum. The lower flap of the wrap sheet is then folded in an upward direction, while the vacuum simultaneously applies a force to an opposite side of the lower flap to keep it flat during folding. The ream is reversed to compress the glue between the lower and upper flaps, forming a rear edge seam on the folio ream.

12 Claims, 11 Drawing Sheets

(56) References Cited

U.S. PATENT DOCUMENTS

| | | | |
|---|---|---|---|
| 3,996,728 | A | 12/1976 | Gentili |
| 4,183,193 | A | 1/1980 | Klingelhofer et al. |
| 4,386,997 | A | 6/1983 | Molitor et al. |
| 4,655,873 | A | 4/1987 | Oly |
| 4,738,078 | A | 4/1988 | Benz et al. |
| 4,989,397 | A | 2/1991 | Tomac et al. |
| 5,072,572 | A | 12/1991 | Meives et al. |
| 5,379,879 | A | 1/1995 | Mantovani et al. |
| 5,457,942 | A | 10/1995 | Mantovani |
| 5,555,968 | A | 9/1996 | Seefeldt et al. |
| 5,960,607 | A | 10/1999 | Bohn et al. |
| 5,992,494 | A | 11/1999 | Focke et al. |
| 6,128,888 | A | 10/2000 | Gambetti |
| 6,280,680 | B1 | 8/2001 | Liang |
| 6,302,678 | B1 | 10/2001 | Mansfeld |
| 6,658,819 | B2 | 12/2003 | Gamberini |
| 6,766,625 | B2 | 7/2004 | Cinotti |
| 6,767,404 | B2 | 7/2004 | Krohmer |
| 6,796,103 | B2 | 9/2004 | Gamberini |
| 6,880,314 | B2 | 4/2005 | Haasl |
| 7,197,862 | B2 | 4/2007 | Daoust et al. |
| 7,503,153 | B2 | 3/2009 | De Matteis |
| 7,721,511 | B2 | 5/2010 | De Matteis |
| 2002/0031569 | A1 | 3/2002 | Mansfeld |

FOREIGN PATENT DOCUMENTS

| | | |
|---|---|---|
| JP | 2255428 | 10/1990 |
| JP | 2258520 | 10/1990 |
| JP | 5193730 | 8/1993 |
| JP | 5193795 | 8/1993 |
| JP | 5229529 | 9/1993 |
| JP | 6345130 | 12/1994 |
| JP | 8164915 | 6/1996 |
| JP | 10072017 | 3/1998 |
| JP | 10250971 | 9/1998 |
| JP | 2000272603 A | 10/2000 |
| JP | 2000335513 A | 12/2000 |
| JP | 2008062980 A | 3/2008 |

METHOD AND APPARATUS FOR WRAPPING A FOLIO REAM OF PAPER

FIELD OF THE DISCLOSURE

This disclosure relates generally to methods and systems for wrapping a ream of paper, and, more particularly, to methods and systems for wrapping a folio ream of paper to form a rear edge seam.

BACKGROUND OF THE DISCLOSURE

Standard ream wrapping of cutsize reams of paper, e.g., reams of paper having the dimensions in the range of about 8.5"×11" up to 14"×20", is typically accomplished with a girth seal on a bottom of the ream. This process is done to maximize the speed at which the wrapping process can be performed. In this method, and as illustrated in FIG. 1, a three piece elevator 1 is used to push a ream 2 into a wrap sheet from below, forming the wrap around the ream 2 on three sides. A bottom girth seal is accomplished via underfold plates 4 that approach the ream 2 from both an upstream and a downstream direction. The three piece elevator 1 allows the elevator 1 to drop out in two stages, allowing the ream 2 to be supported in a middle area 5 while the underfold is being initiated.

The above-described process for wrapping cutsize reams of paper, however, is not as feasible in folio ream applications, as the folio reams of paper are much larger than the cutsize reams of paper, with the folio reams of paper having the dimensions of about 36"×about 52", for example. As such, the amount of unsupported paper from the folio ream is too great for the cutsize paper wrapping process. To avoid this problem, traditional folio wrappers place the girth seal on a top portion of the ream, which may be accomplished in a variety of different ways, as understood by one of ordinary skill in the art. However, having the girth seal on the top of the folio ream poses other problems. Specifically, the glue used to seal the girth seam becomes a pressure point on the top and bottom surfaces of the reams as the reams are stacked. This issue is especially prevalent when lightweight paper is the product being wrapped. Under the weight of multiple reams of stacked folio paper, the girth seams can undesirably crease or otherwise damage several sheets at the top of many of the reams. Additionally, the girth seals on the top of several stacked folio reams collectively create a crowning effect, limiting the number of reams that can be stacked on a pallet.

SUMMARY OF THE DISCLOSURE

The present disclosure is directed to a method and apparatus for wrapping a folio ream of paper. More specifically, in one example of the present disclosure, a method of wrapping a folio ream comprises pre-creasing a wrap sheet such that the wrap sheet creases or dents before a front edge of the folio ream reaches the wrap sheet, positioning the wrap sheet such than an upper flap and a lower flap of the wrap sheet are ready to be folded along a rear edge of the folio ream, and driving the folio ream into the wrap sheet toward a fold position. The method further comprises forming a bubble of wrap in the wrap sheet while the folio ream advances toward the fold position, cutting the wrap sheet while the folio ream is advancing toward the fold position, such that the lower flap extends beyond a lower rear edge of the folio ream after the ream stops at the fold position, and holding the lower flap to a top portion of the folio ream. In addition, the method comprises forming an upper flap fold on the rear edge of the folio ream, applying glue to an inner surface of the lower flap of the wrap sheet while holding an outer surface of the lower flap of the wrap sheet flat via a vacuum, folding the lower flap of the wrap sheet in an upward direction while simultaneously applying a force to the bottom surface of the lower flap via the vacuum to keep the lower flap flat during folding. The inner surface of the lower flap of the wrap sheet is affixed to an outer surface of the upper flap of the wrap sheet and the folio ream is then reversed to compress the glue from the lower flap to the upper flap to form a rear edge seam on the folio ream.

In some examples, a lower flap may extend a short distance beyond a rear edge of the ream after the ream stops at the fold position.

In other examples, forming the upper flap fold may comprise folding the upper flap via a servo actuated upper folding unit, and folding the upper flap via a servo actuated upper folding unit further comprises extending the upper folding unit in a downward direction while the ream is nipped by an upper intermediate conveyor and a lower intermediate conveyor.

The method may further comprise ironing any loose wrap in the upper flap by the upper folding unit.

In addition, folding the lower flap of the wrap sheet in an upward direction may further comprise holding the glue away from the upper folding unit via the vacuum.

Further, folding the lower flap of the wrap sheet in an upward direction may comprise folding the lower flap via a servo actuated lower folding unit.

Still further, pre-creasing the wrap sheet comprises forming creases at two points on the wrap sheet, the two points at a location on the wrap sheet adjacent and parallel to a location of two front edges of the front end of the folio ream, such that when the folio ream advances and contacts the wrap sheet, the two front edges of the folio ream contact the two creases of the wrap sheet, allowing the wrap sheet to easily fold over the folio ream.

In another example of the present disclosure, an apparatus for wrapping a folio ream of paper to form a rear edge seam comprises a first station having a lower infeed conveyor, an upper infeed conveyor, and a folio ream disposed on the lower infeed conveyor and nipped by the upper infeed conveyor. The apparatus further comprises a second station having a pre-creased wrap sheet and a pair of vacuum belts that hold the wrap sheet before the folio ream is driven through the wrap sheet. A cutting mechanism for cutting the wrap sheet after a bubble of wrap is formed in the wrap sheet is also included. The apparatus also comprises a third station having an upper intermediate conveyor, a lower intermediate conveyor, a fold position, an upper folding unit, and a lower folding unit, the lower folding unit having a vacuum that provides a force on a bottom surface of the lower flap to maintain a flat position of the lower flap. The lower and upper intermediate conveyors are arranged to actuate the folio in a downstream direction and an upstream direction.

In yet another example method of the present disclosure, a method of wrapping folio ream comprises actuating a folio ream to be wrapped in a downstream direction, pre-creasing a wrap sheet such that the wrap sheet creases before a front edge of the folio ream reaches the wrap sheet, and forming a bubble of wrap in the wrap sheet and cutting the wrap sheet while the folio ream is advancing toward a fold position, such that a lower flap and an upper flap of the wrap sheet extend beyond a rear edge of the folio ream after the ream stops at the fold position. The method further comprises forming an upper flap fold on the rear edge of the folio ream with the upper flap when the ream is at the fold position, applying glue to a top surface of the lower flap of the wrap sheet while holding a bottom surface of the lower flap of the wrap sheet flat via a vacuum, and folding the lower flap of the wrap sheet in an upward direction while simultaneously applying a force to the bottom surface of the lower flap via the vacuum until the glue contacts an outside surface of the upper flap fold, such that opposing forces act on opposing surfaces of the lower flap to keep the lower flap flat during folding.

Lastly, yet another method of wrapping a folio ream comprises actuating a folio ream to be wrapped in a downstream direction, pre-creasing a wrap sheet such that the wrap sheet creases before a front edge of the folio ream reaches the wrap sheet, and forming a bubble of wrap in the wrap sheet after the front edge of the folio ream contacts the wrap sheet and before the folio ream reaches a fold position. The method further comprises extending a first flap of the wrap sheet and a second flap of the wrap sheet beyond a rear edge of the folio ream when the folio ream reaches the fold position, holding one of the first flap or the second flap to a portion of the folio ream, and folding one of the first flap or the second flap to form a first fold on the rear edge of the folio ream. The method further comprises applying glue to one of a top surface or a bottom surface of the other of the first flap or the second flap while holding the surface opposite one of the top surface or the bottom surface of the other of the first flap or the second flap flat via a vacuum and folding the other one of the first flap or the second flap to form a second fold on the rear edge of the folio ream and simultaneously applying a force to the surface opposite one of the top surface or the bottom surface of the other of the first flap or the second flap via the vacuum to keep one of the first flap or the second flap flat during folding. Lastly, the method also comprises reversing the folio ream, effectively utilizing the folio ream as a platen-like tool to compress the glue from one of the first flap or the second flap to form a rear edge seam on the folio ream.

DETAILED DESCRIPTION OF THE PREFERRED EMBODIMENTS

Generally, an apparatus and method for wrapping a folio ream of paper to form a rear girth seam is disclosed. GRM is a folio size ream paper that can wrap paper as well as other specialty products in an outer wrap typically made of SBS and SUS paper. A rear girth (RG) GRM (RG-GRM) wrap cycle of the present disclosure includes a process for automatically wrapping the folio ream of paper that puts a main girth glue seam on a vertical trailing or rear edge of the ream of paper. In this way, when the reams are stacked on a pallet, there is no pressure applied to the glue seam, which saves sheets of paper of the ream (which might otherwise be marred by markings resulting from pressure imparted to the top few sheets of a given ream due to glue seams on the plane of the bottom of the reams stacked above that given ream) and prevents crowning (which tends to limit the stability and number of reams that can be stacked). The ream is also more stable on the pallet. The following disclosure and claims set forth an automated process by which the rear girth seam is formed.

Figure 1:
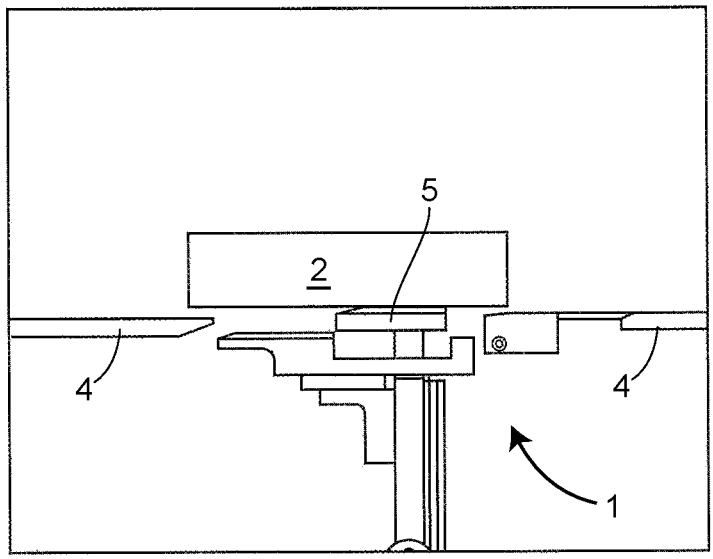
FIG. 1 Prior Art
FIG. 1 is sectional view of a prior art apparatus for wrapping a cutsize ream of paper to form a girth seal on a bottom of the ream.
Figure 2:
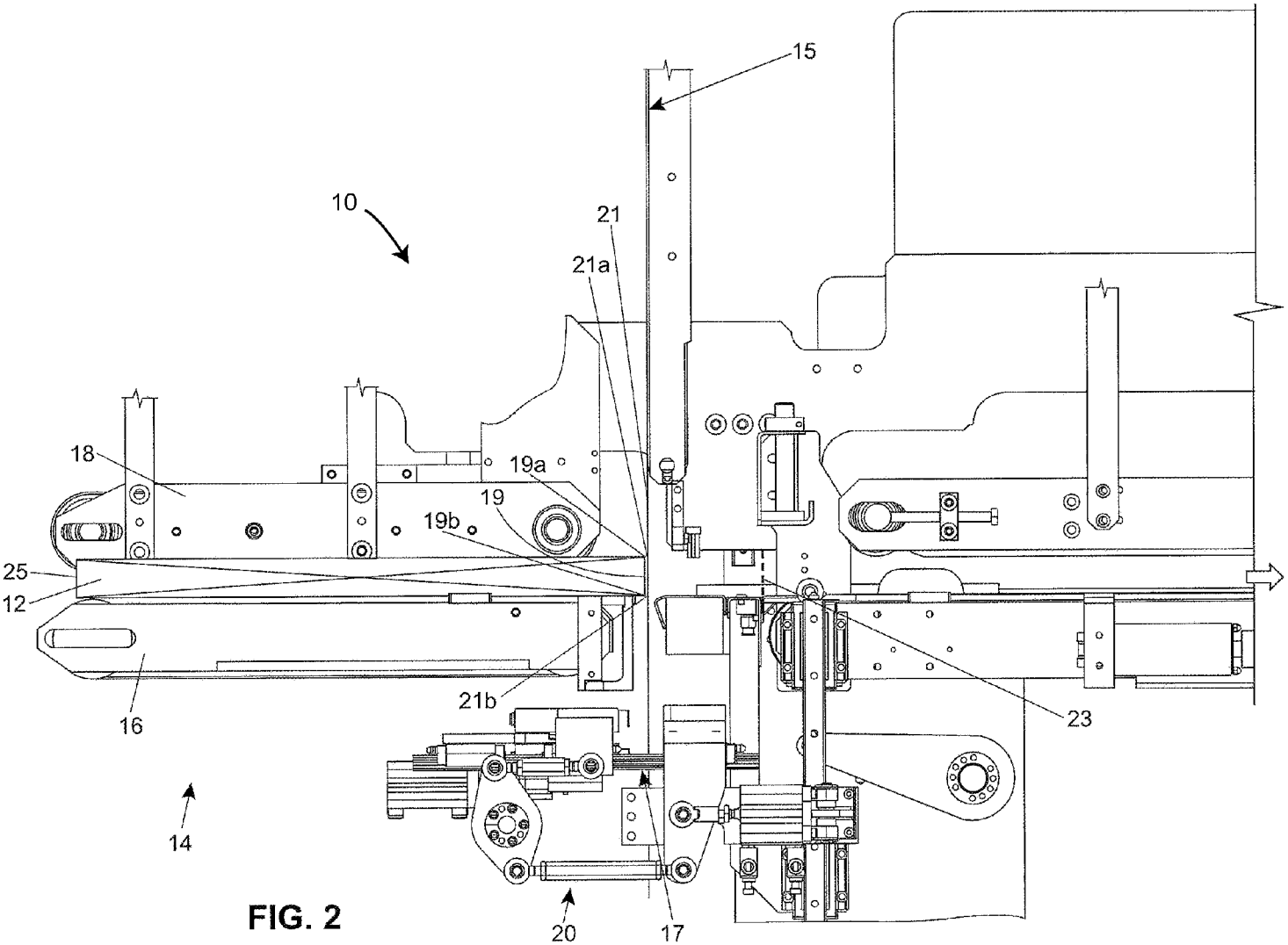
FIG. 2 is a sectional view of an apparatus for wrapping a ream of folio paper of the present disclosure, wherein the ream of paper is disposed on a first station and is approaching a wrap sheet.

More specifically, and referring now to FIG. 2, an apparatus 10 for automatically wrapping a folio ream of paper 12 is illustrated. The apparatus 10 includes a first station 14 having a lower infeed conveyor (L INF C) 16 and an upper infeed conveyer 18. The ream 12 is disposed on the lower infeed conveyor (L INF C) 16 and is nipped by the upper infeed conveyor (U INF C) 18.

The apparatus 10 further includes a second station 20 having a pre-creased wrap sheet 21 with a pair of pre-creased points 21*a* and 21*b*. More specifically, in one example, the creases are formed at two points in the wrap sheet 21 that are adjacent and parallel to a location of two front edges 19*a*, 19*b* of a front end 19 of the folio ream 21. As such, when the folio ream 12 advances and contacts the wrap sheet 21, the two front edges 19*a*, 19*b* of the ream 12 contact the two creases 21*a*, 21*b* of the wrap sheet 21, allowing the wrap sheet 21 to easily fold over the folio ream 12. A pair of vacuum belts 15 hold the wrap sheet 21 taut before the folio ream 12 is driven through the wrap sheet 21. By pre-creasing the wrap sheet 21 at such points, the wrap sheet 21 creases or dents before a front edge 19 of the folio ream 12 reaches the wrap sheet 21.

As further illustrated in FIG. 2, the second station 20 also includes a cutting mechanism 17 for cutting the wrap sheet 21 after a bubble of wrap 24 (FIG. 3) is formed in the wrap sheet 21, as explained in more detail below. The wrap sheet 21 is positioned so that when the ream of paper 12 is driven through it and a rear edge 25 of the wrap sheet 21 arrives at a fold position 23, upper and lower flaps 26, 28 (FIG. 4), respectively, of the wrap sheet 21 are ready to be folded. This is different than a normal cycle in that the normal cycle positions the wrap sheet 21 so that a top edge of the wrap sheet 21 ends up on a top surface of the ream 12 approximately 140 mm, for example, from the rear edge 25 of the ream.

Figure 3:
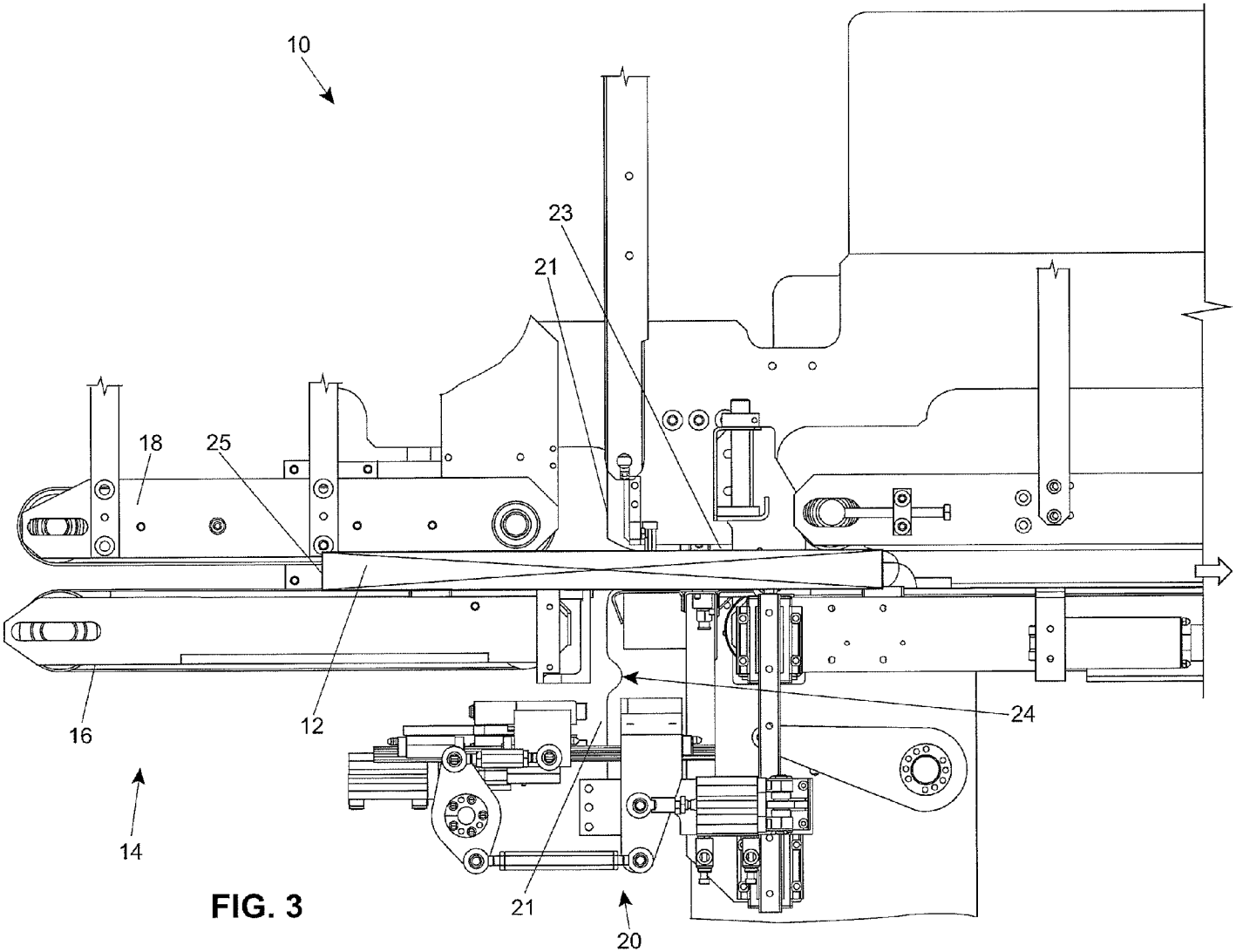
FIG. 3 is another sectional view of the apparatus for wrapping a ream of paper of FIG. 2, wherein the wrap sheet is partially disposed around the ream of paper and traveling to a fold position.

Referring now to FIG. 3, the ream 12 has passed through the wrap sheet 21 and travels downstream until the rear edge 25 of the ream 12 reaches the fold position 23. During the RG-GRM wrap cycle, the wrap sheet 21 is cut by the cutting mechanism while the ream of paper 12 is still moving. This is so that the lower flap 28 (FIG. 4) will extend a short distance, such as 20 mm, beyond the rear edge 25 of the ream 12 after the rear edge 25 of the ream 12 reaches and stops at the fold position 23. To achieve this, the "bubble of wrap" 24 is formed while the ream 12 advances towards the fold position 23.

Figure 4:
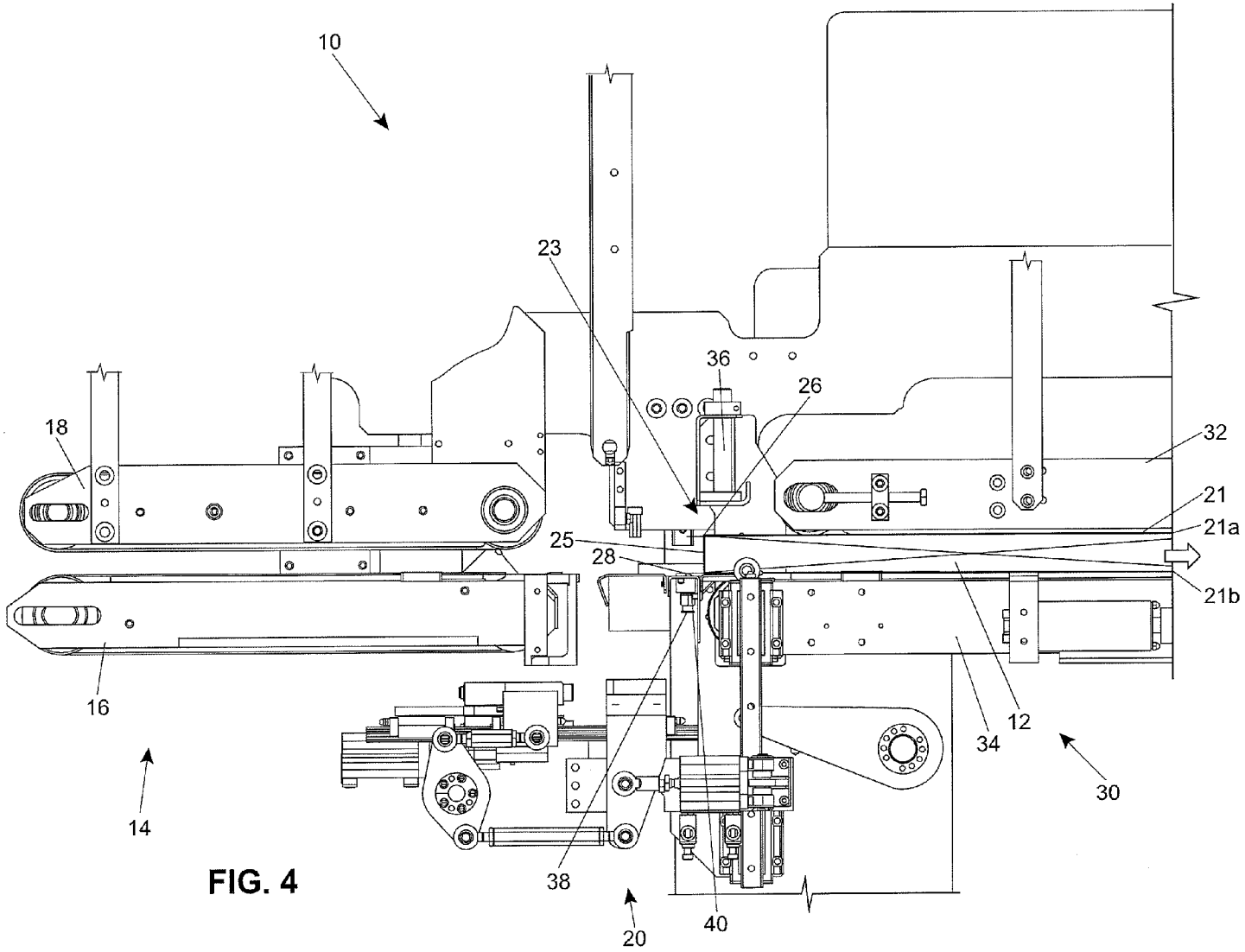
FIG. 4 is another sectional view of the apparatus for wrapping a ream of paper of FIG. 2, wherein the folio ream is at the fold position.

Referring now to FIG. 4, the apparatus 10 further includes a third station 30. The third station 30 includes an upper intermediate conveyor 32, a lower intermediate conveyor 34, the fold position 23, an upper folding unit 36, and a lower folding unit 38. The upper and lower folding units 36, 38 are controlled by dual axis servo motors that are synchronized, as explained in more detail below. In addition, the upper intermediate conveyor 32 and the lower intermediate conveyor 34 are servo actuated and controlled, and are also adapted to run at an equal speed, an equal acceleration and an equal position via synchronized servomotors. In one example, the servomotors are SIEMENS #1FK7042-5AF71-1UG0 synchronous servomotor, the servo drive is SIEMENS #6SL3120-2TE13-0AA3 SINIMICS, and the dual axis servo module is a 3 AMPS continuous, 6 AMPS peak, 1.6 KW module. In another example, the motion controller is SIEMENS #6ES7317-6TK13-0AB0, S7-317T-2 DP TECHNOLOGY CPU 512 KB with an integrated motion controller.

The lower folding unit 38 further includes a vacuum 40 that provides a force on a bottom or outer surface of the lower flap 28 to maintain a flat position of the lower flap 28 during folding. More specifically, and in one example, the vacuum 40 provides the force on the bottom or outer surface of the lower flap 28 until glue contacts an outside surface of an upper flap fold, as explained in more detail below. Said another way, suction or opposing forces act on surfaces of the lower flap 28 to keep the lower flap 28 flat during folding. Once the rear edge 25 of the ream 12 arrives at the fold position 23, as depicted in FIG. 4, the upper flap 26 and the lower flap 28 are ready to be folded or formed down and up, respectively.

Figure 5:
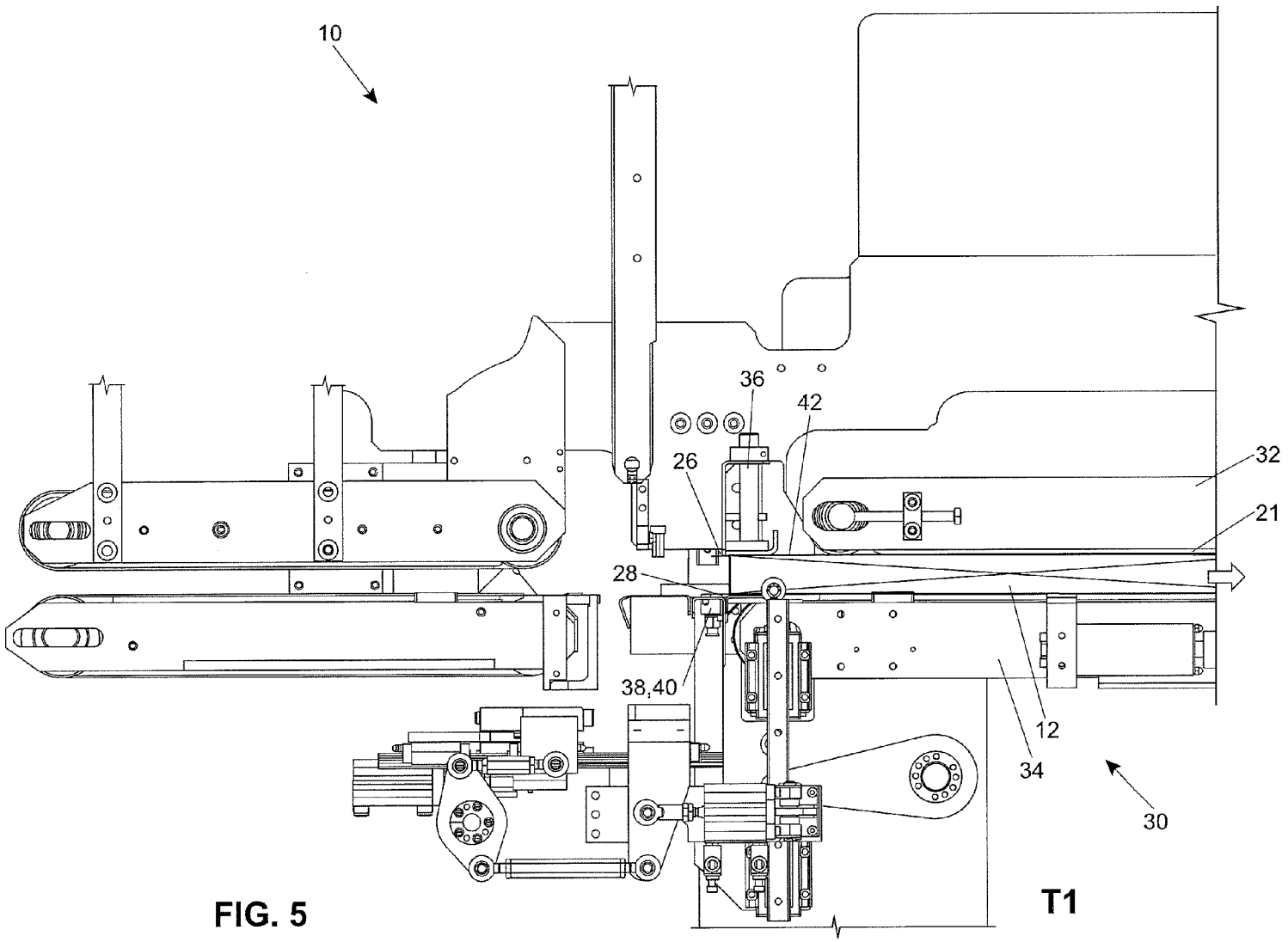
FIG. 5 is another sectional view of the apparatus for wrapping a ream of paper of FIG. 2, wherein an upper folding unit has been lowered to hold an upper flap of the wrap sheet.
Figure 6:
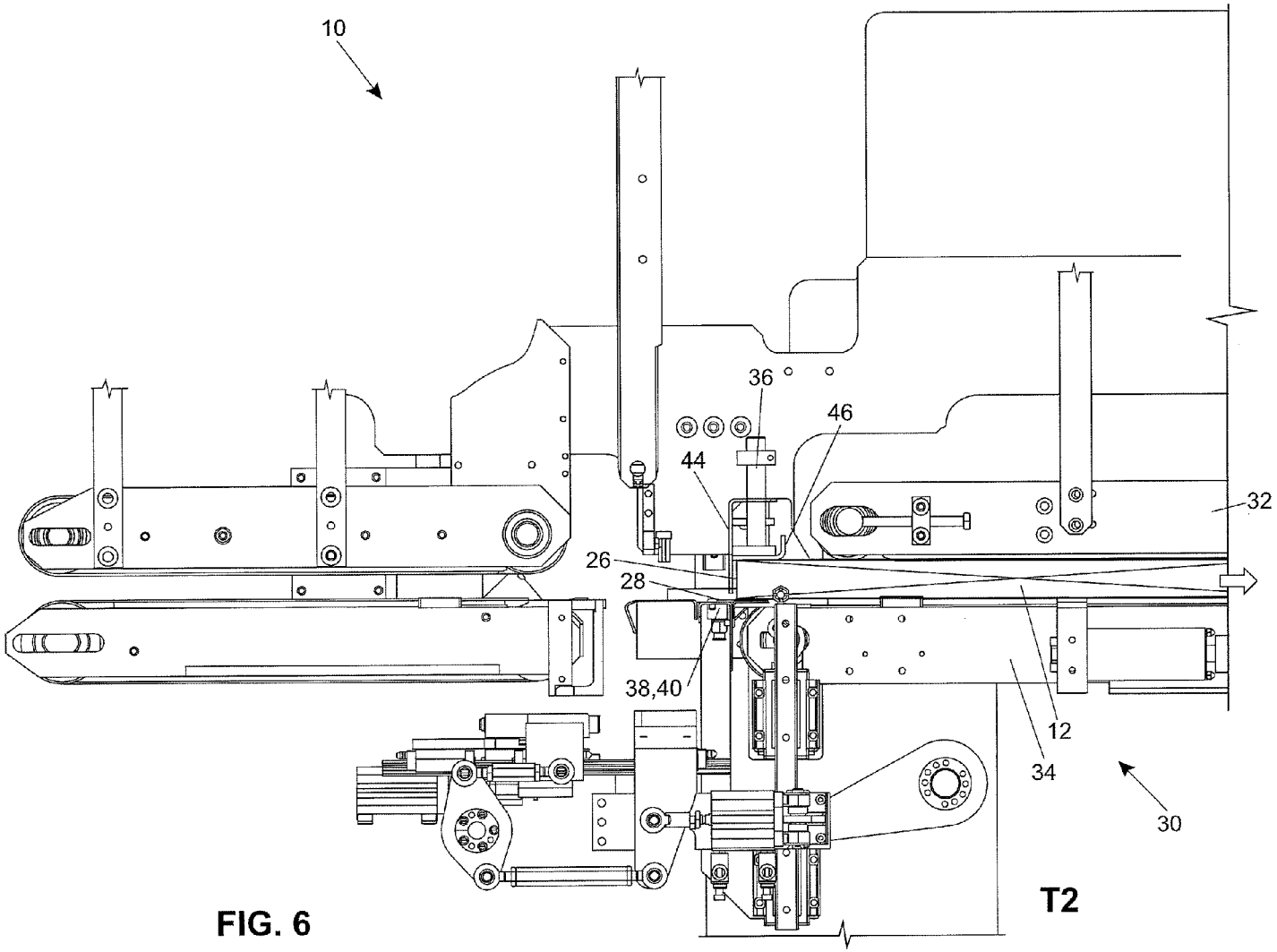
FIG. 6 is another sectional view of the apparatus for wrapping a ream of paper of FIG. 2, wherein a portion of the upper folding unit is lowered again to achieve an upper flap fold.

Referring now to FIGS. 5 and 6, part of the process of forming an upper flap fold on the rear edge 25 of the folio ream 12 is depicted. More specifically, at a time T1 depicted in FIG. 5, the upper folding unit 36 has been lowered to hold the upper flap 26 to a top portion 42 of the folio ream 12. At a time T2 depicted in FIG. 6, a bar portion 44 of the upper folding unit 36 is lowered to fold down the upper flap 26, forming the upper flap fold. The upper folding unit 36 is servo actuated and extends down in a controlled fashion while the ream 12 is nipped by the upper and lower intermediate conveyors (U INT C) & (L INT C) 32, 34, respectively, of the third station 30 of the apparatus 10. The bar portion 44 of the upper folding unit 36 may aided by a vertically guided member 46 to help hold the back of the ream 12 down during the folding process.

Figure 7:
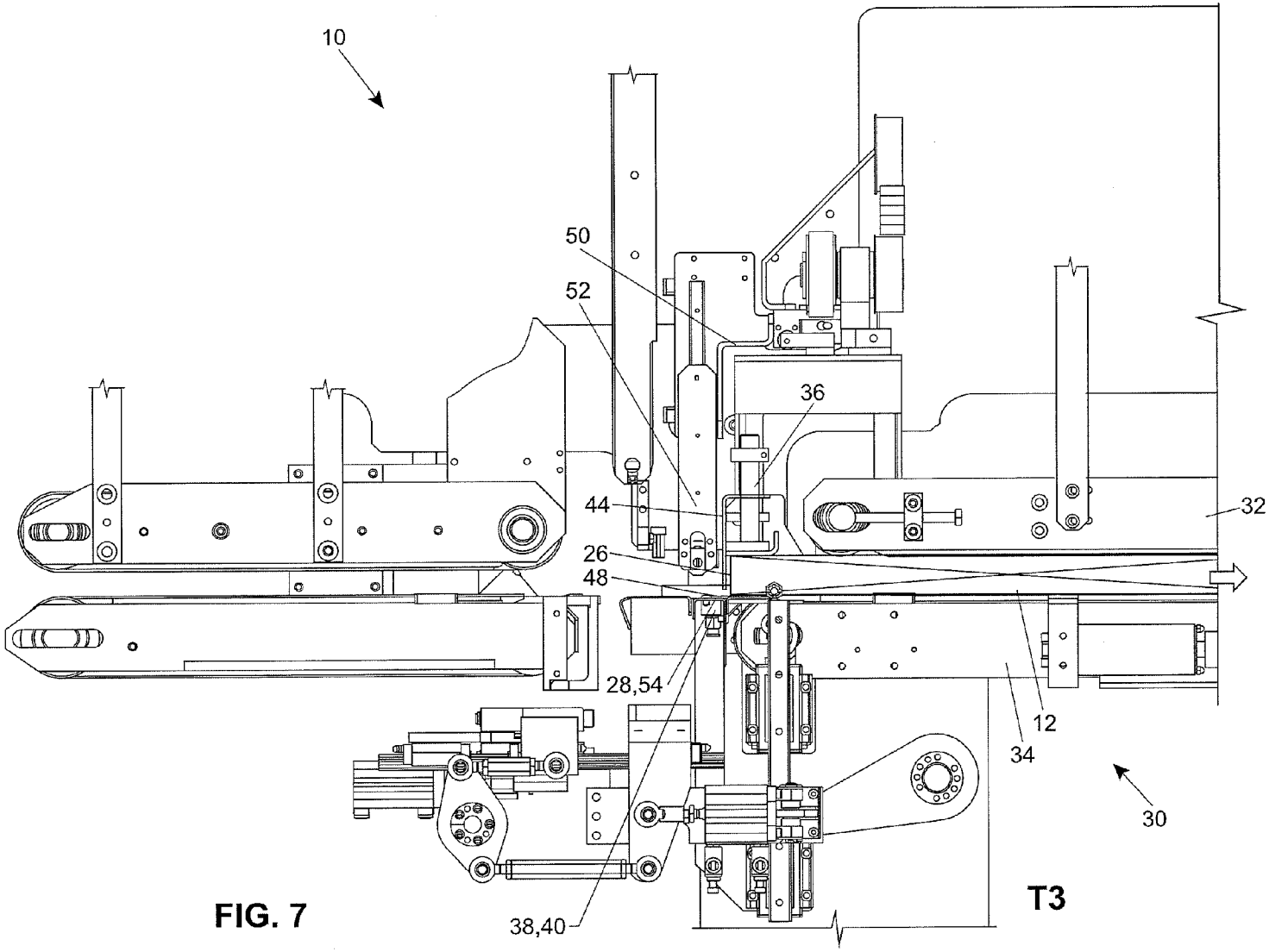
FIG. 7 is a sectional view of the apparatus for wrapping a ream of paper of FIG. 2, wherein glue is applied to an inner or top surface of a lower flap.

Referring now to FIG. 7, a time T3 is depicted in which the upper folding unit 36 continues to hold the upper flap 26 down while glue is applied to a top or an upper surface 48 of the lower flap 28. More specifically, a transversal glue unit 50 lowers via pneumatics and travels across the apparatus 10 to apply glue to the top or upper surface 48 of the lower flap 28 of the wrap sheet 21 at a consistent distance from the lower flap 28, for example. A glue head 52 of the transversal glue unit 50 is also servo controlled. While the glue is being applied, a bottom or lower surface 54 of the lower flap 28 is being held flat by the vacuum 40 of the lower folding unit 38.

Figure 8:
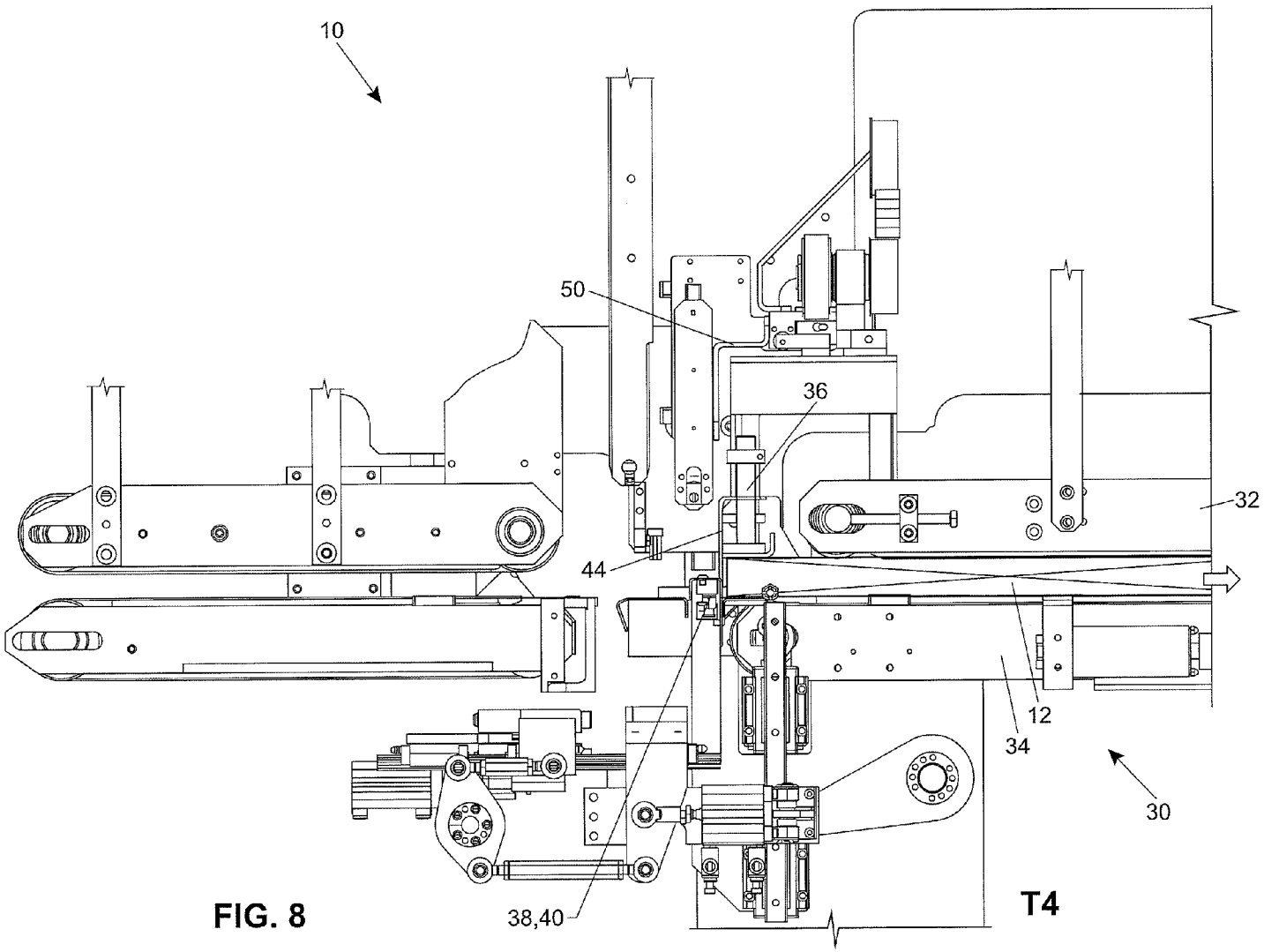
FIG. 8 is a sectional view of the apparatus for wrapping a ream of paper of FIG. 2, wherein a glue head for applying the glue is raised to accommodate a lower folding unit moving in an upward direction.
Figure 9:
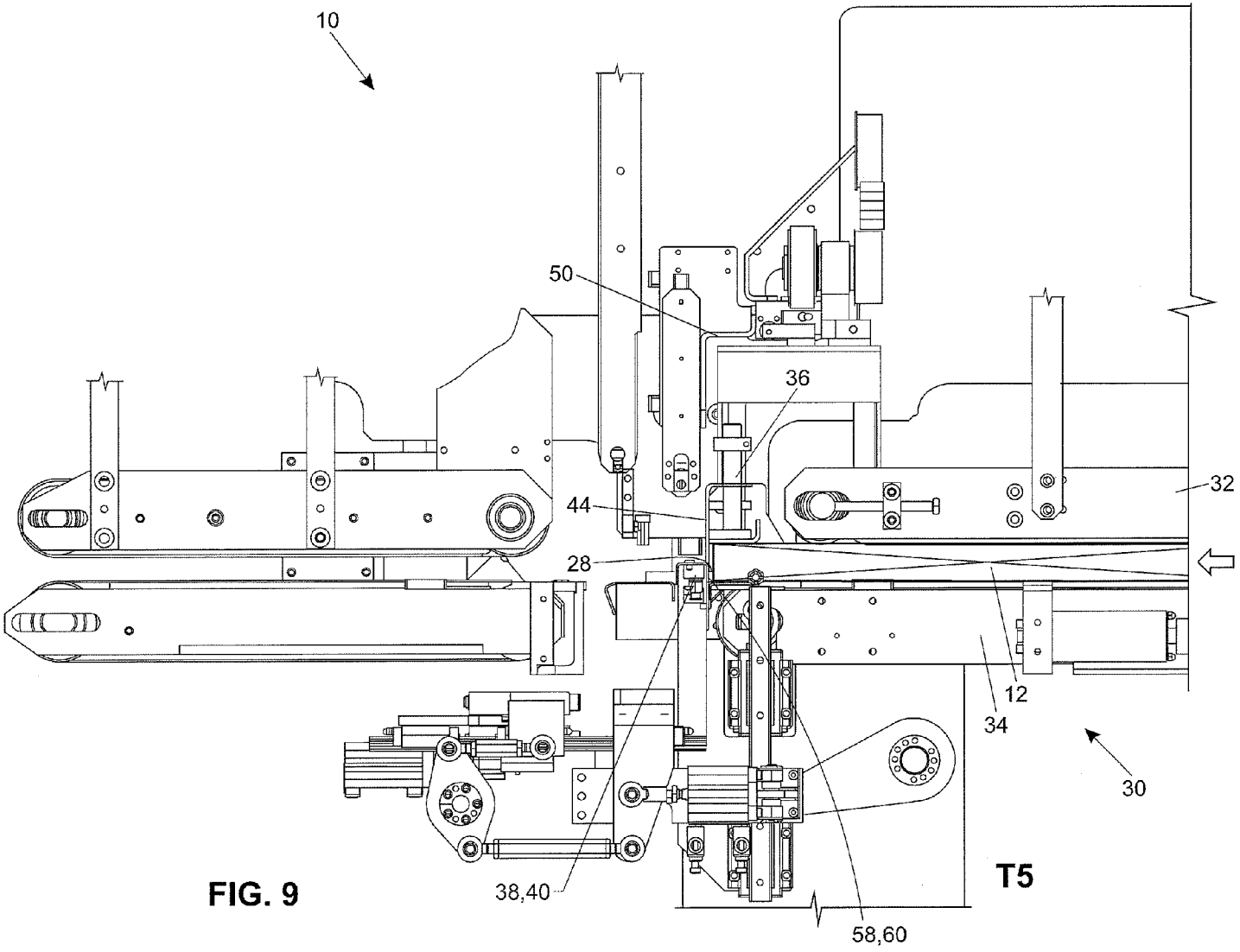
FIG. 9 is a sectional view of the apparatus for wrapping a ream of paper of FIG. 2, wherein the lower folding unit rises to hold the lower flap against the upper flap and the direction of the folio ream is reversed to compress the glue between the lower flap and the upper flap.

Referring now to FIGS. 8 and 9, part of the process of forming a lower flap fold on the rear edge 25 of the folio ream is depicted. More specifically, at a time T4 depicted in FIG. 8, the transversal glue unit 50 is raised to accommodate upward movement of the lower folding unit 38. At a time T5 depicted in FIG. 9, the lower folding unit 38 rises and is servo matched to the upper folding unit 36, causing the lower flap 28 of the wrap sheet 21 to be folded in an upward direction along the rear edge 25 of the ream 12. During such upward movement of the lower folding unit 38, the vacuum 40 of the lower folding unit 38 holds the lower flap 28 flat or taut during folding until the lower flap 28 reaches the rear edge 25 of the ream 12. The servoization of both the upper and lower folding units 36, 38 allows the two folding axes to move together and maintain a small gap between them. The glue may pass through this small gap, affixing the lower flap 28 of the wrap sheet 21 to the upper flap fold of the wrap sheet 21.

As further depicted in FIG. 9, the direction of the ream 12 is then reversed, effectively utilizing the ream 12 as a platen-like tool to compress the glue between the upper flap fold and the lower flap 28, forming a rear girth seam 56 (FIG. 10) on the rear edge 25 of the ream 12. In other words, the folio ream 12 moves in an upstream direction or a direction opposite the direction of travel the ream 12 typically advances during the method of wrapping the folio ream 12 process. More specifically, after the lower folding unit 38 is completely raised, the upper and lower intermediate belts 32, 34 are electronically geared together. A move position is then commanded to move the ream 12 back a short distance, for example about 5 mm. This reverse movement compresses the glue between the lower folding unit 38 and the paper inside the ream 12. As also illustrated in FIG. 9, the lower folding unit 38 further includes a front face 58 having a compliant material 60 adhered thereto to overcome a locally uneven vertical surface on the back of the ream 12. Thus, when the ream 12 is reversed the glue is compressed between the ream 12 and the compliant material 60.

Figure 10:
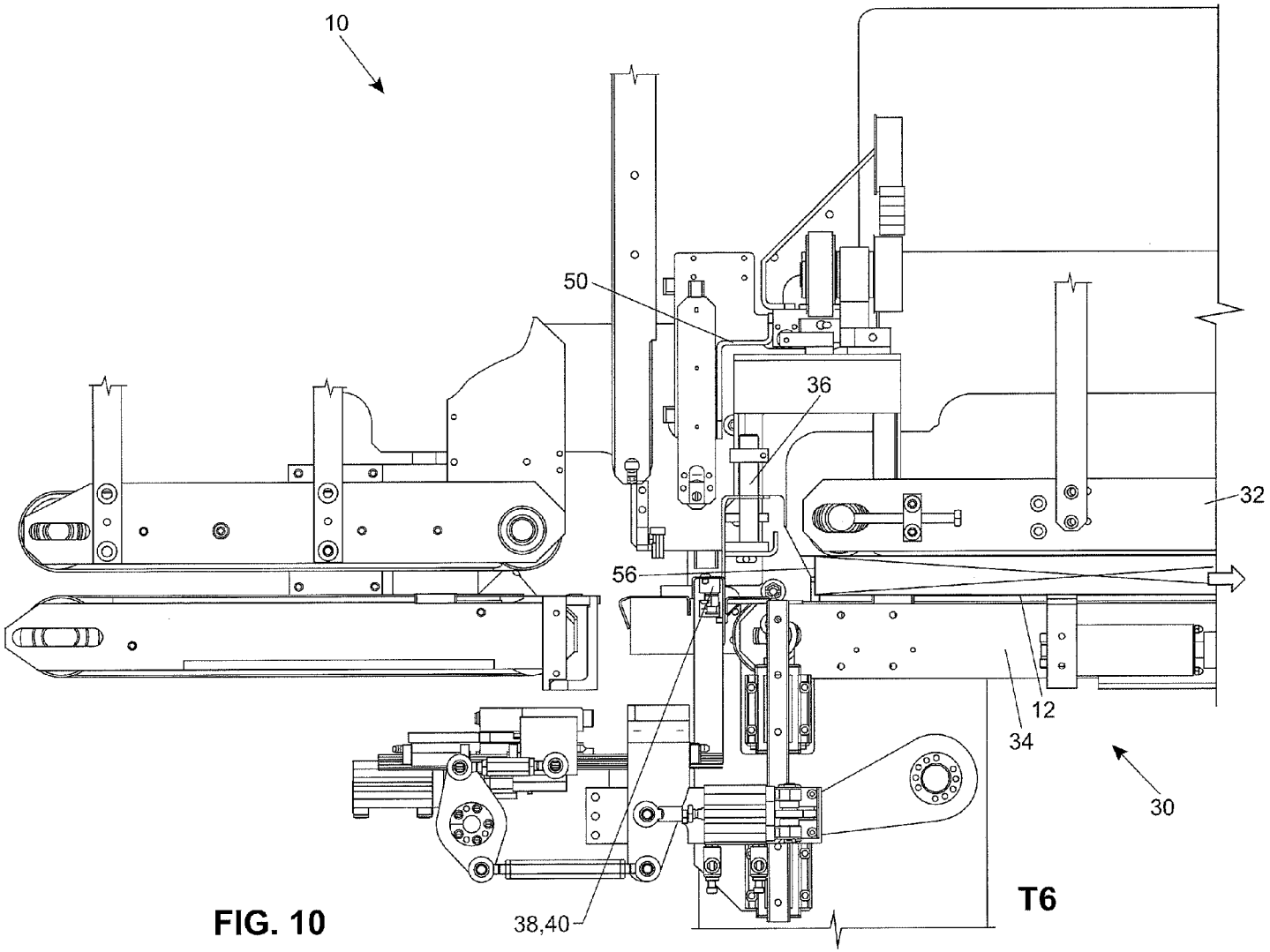
FIG. 10 is a sectional view of the apparatus for wrapping a ream of paper of FIG. 2, wherein a rear girth seam at the rear edge of the folio ream is complete and the folio ream advances in a downstream direction to complete a fold cycle.
Figure 11:
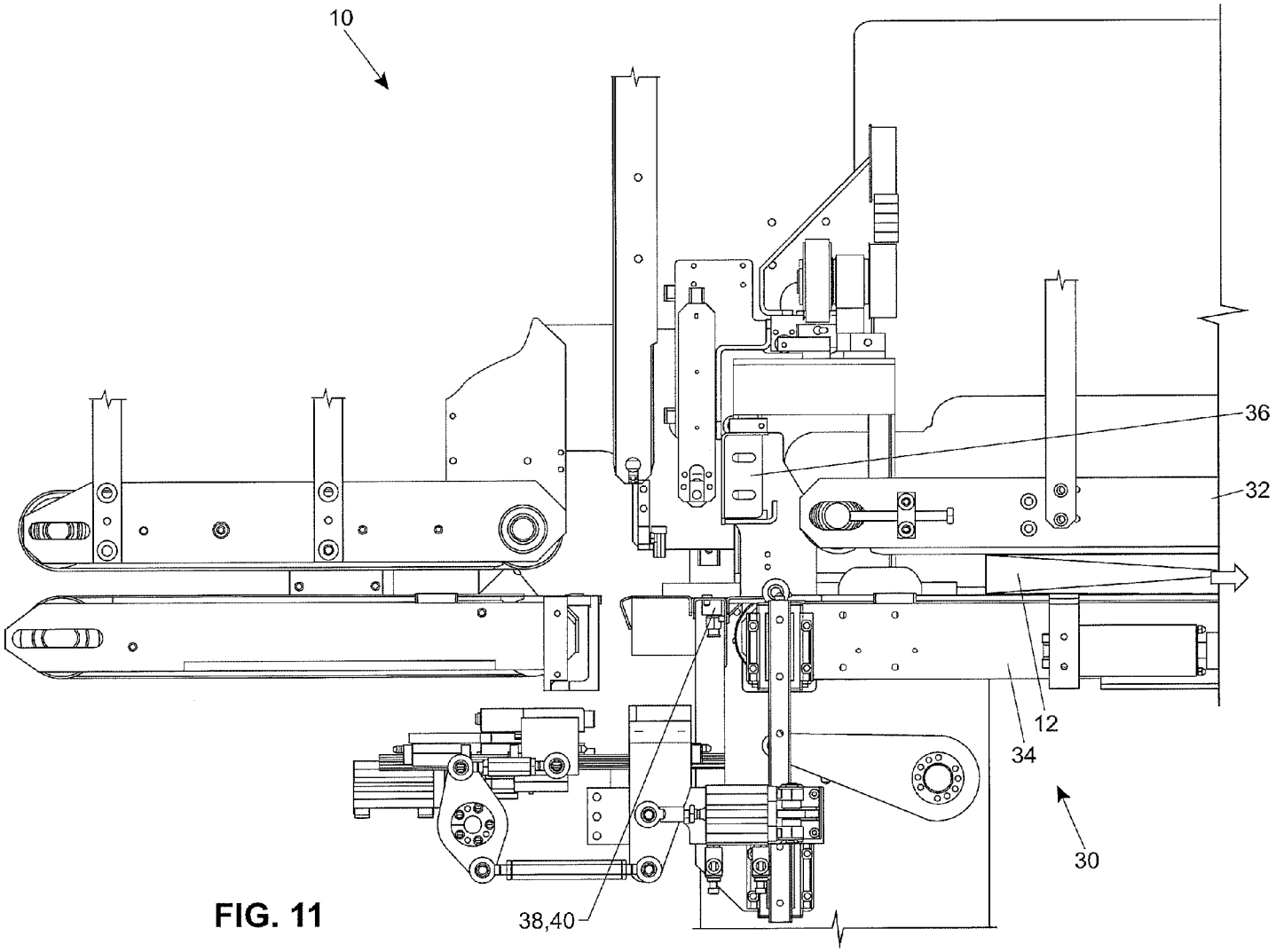
FIG. 11 is a sectional view of the apparatus for wrapping a ream of paper of FIG. 2, wherein the upper and lower folding units are returned to a start position and the apparatus is ready to accept another folio ream for wrapping.

Referring now to FIG. 10, the rear girth seam 56 is complete and the wrapped ream 12 advances back to a downstream direction to complete a fold cycle or the wrapping of the folio ream 12. Thereafter, the upper and lower folding units 36, 38 return to a start or home position and the apparatus 10 is ready to accept another folio ream for wrapping, as illustrated in FIG. 11. More specifically, the upper folding unit 36 moves up to the start position via a servo actuator and the lower folding unit 38 moves down to the start position via another servo actuator.

While the preceding text sets forth a detailed description of numerous different examples of the invention, it should be understood that the legal scope of the invention is defined by the words of the claims set forth at the end of this disclosure. The detailed description is to be construed as exemplary only and does not describe every possible embodiment or example of the invention, as describing every possible embodiment would be impractical, if not impossible. Numerous alternative embodiments or examples could be implemented, using either current technology or technology developed after the filing date of this patent, which would still fall within the scope of the claims of the patent. More generally, although certain example systems and methods have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method of wrapping a folio ream, the method comprising:

pre-creasing a wrap sheet such that the wrap sheet creases or dents before a front edge of the folio ream reaches the wrap sheet;

positioning the wrap sheet such that an upper flap and a lower flap of the wrap sheet are ready to be folded along a rear edge of the folio ream;

driving the folio ream into the wrap sheet toward a fold position;

forming a bubble of wrap in the wrap sheet while the folio ream advances toward the fold position;

cutting the wrap sheet while the folio ream is advancing toward the fold position, such that the lower flap extends beyond a lower rear edge of the folio ream after the ream stops at the fold position;

holding the upper flap to a top portion of the folio ream;

forming an upper flap fold on the rear edge of the folio ream;

applying glue to an inner surface of the lower flap of the wrap sheet while holding an outer surface of the lower flap of the wrap sheet flat via a vacuum;

folding the lower flap of the wrap sheet in an upward direction and simultaneously applying a force to the outer surface of the lower flap via the vacuum to keep lower flap flat during folding;

affixing the inner surface of the lower flap of the wrap sheet to an outer surface of the upper flap of the wrap sheet; and reversing the folio ream to compress the glue from the lower flap to the upper flap to form a rear edge seam on the folio ream.

2. The method of claim 1, wherein the lower flap extends a short distance beyond the rear edge of the ream after the ream stops at the fold position.

3. The method of claim 1, wherein forming the upper flap fold further comprises folding the upper flap via a servo actuated upper folding unit.

4. The method of claim 3, wherein folding the upper flap via the servo actuated upper folding unit further comprises extending the upper folding unit in a downward direction while the ream is nipped by an upper intermediate conveyor and a lower intermediate conveyor.

5. The method of claim 4, further comprising ironing any loose wrap in the upper flap by the upper folding unit.

6. The method of claim 1, wherein folding the lower flap of the wrap sheet in an upward direction further comprises holding the glue away from the upper folding unit via the vacuum.

7. The method of claim 1, wherein folding the lower flap of the wrap sheet in an upward direction further comprises folding the lower flap via a servo actuated lower folding unit.

8. The method of claim 1, wherein pre-creasing the wrap sheet comprises forming creases at two points on the wrap sheet, the two points at a location on the wrap sheet adjacent and parallel to a location of two front edges of the front end of the folio ream, such that when the folio ream advances and contacts the wrap sheet, the two front edges of the folio ream contact the two creases of the wrap sheet, allowing the wrap sheet to easily fold over the folio ream.

9. A method of wrapping a folio ream, the method comprising:

actuating a folio ream to be wrapped in a downstream direction;

pre-creasing a wrap sheet such that the wrap sheet creases before a front edge of the folio ream reaches the wrap sheet;

forming a bubble of wrap in the wrap sheet and cutting the wrap sheet while the folio ream is advancing toward a fold position, such that a lower flap and an upper flap of the wrap sheet extend beyond a rear edge of the folio ream after the ream stops at the fold position;

forming an upper flap fold on the rear edge of the folio ream with the upper flap when the ream is at the fold position;

applying glue to a top surface of the lower flap of the wrap sheet while holding a bottom surface of the lower flap of the wrap sheet flat via a vacuum;

folding the lower flap of the wrap sheet in an upward direction and simultaneously applying a force to the bottom surface of the lower flap via the vacuum until the glue contacts an outside surface of the upper flap fold, such that opposing forces act on opposing surfaces of the lower flap to keep the lower flap flat during folding;

reversing the direction in which the folio ream is actuated, such that the folio ream moves in an upstream direction for a predetermined distance, to compress the glue from the lower flap to the upper flap, thereby forming a rear edge seam on the folio ream; and then advancing the folio ream in a downstream direction to complete wrapping of the folio ream.

10. The method of claim 9, wherein actuating the folio ream to be wrapped in a downstream direction includes driving the folio ream between an upper infeed conveyor and a lower infeed conveyor.

11. The method of claim 10, wherein reversing the direction in which the folio ream is actuated includes signaling electronically coupled servo motors driving the upper and lower intermediate conveyors to reverse direction.

12. A method of wrapping a folio ream, the method comprising:

actuating a folio ream to be wrapped in a downstream direction;

pre-creasing a wrap sheet such that the wrap sheet creases before a front edge of the folio ream reaches the wrap sheet;

forming a bubble of wrap in the wrap sheet before cutting the wrap sheet but after the front edge of the folio ream contacts the wrap sheet and before the folio ream reaches a fold position;

extending a first flap of the wrap sheet and a second flap of the wrap sheet beyond a rear edge of the folio ream when the folio ream reaches the fold position;

holding one of the first flap or the second flap to a portion of the folio ream;

folding one of the first flap or the second flap to form a first fold on the rear edge of the folio ream;

applying glue to one of a top surface or a bottom surface of the other of the first flap or the second flap while holding the surface opposite one of the top surface or the bottom surface of the other of the first flap or the second flap flat via a vacuum;

folding the other of the first flap or the second flap to form a second fold on the rear edge of the folio ream and simultaneously applying a force to the surface opposite one of the top surface or the bottom surface of the other of the first flap or the second flap via the vacuum to keep the one of the first flap or the second flap flat during folding; and reversing the folio ream to compress the glue from one of the first flap or the second flap to form a rear edge seam on the folio ream.

* * * * *